US011187042B2

(12) United States Patent
Doud et al.

(10) Patent No.: US 11,187,042 B2
(45) Date of Patent: Nov. 30, 2021

(54) CURVED PISTON LINER AND INTEGRAL PAD ASSEMBLY

(71) Applicant: Halliburton Energy Services, Inc., Houston, TX (US)

(72) Inventors: Brian Lee Doud, Spring, TX (US); Neelesh V. Deolalikar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 73 days.

(21) Appl. No.: 16/652,946

(22) PCT Filed: Mar. 2, 2018

(86) PCT No.: PCT/US2018/020786
§ 371 (c)(1),
(2) Date: Apr. 1, 2020

(87) PCT Pub. No.: WO2019/133036
PCT Pub. Date: Jul. 4, 2019

(65) Prior Publication Data

US 2020/0318436 A1 Oct. 8, 2020

Related U.S. Application Data

(60) Provisional application No. 62/612,213, filed on Dec. 29, 2017.

(51) Int. Cl.
*E21B 7/06* (2006.01)

(52) U.S. Cl.
CPC ..... *E21B 7/06* (2013.01)

(58) Field of Classification Search
CPC ..... E21B 7/06
See application file for complete search history.

(56) References Cited

U.S. PATENT DOCUMENTS 4,394,881 A 7/1983 Shirley
5,582,260 A 12/1996 Murer et al.
(Continued)

FOREIGN PATENT DOCUMENTS

EP 0402167 12/1990
EP 0841462 2/2003
(Continued)

OTHER PUBLICATIONS

ISRWO International Search Report and Written Opinion for PCT/US2018/020786 dated Sep. 21, 2018.

*Primary Examiner* — D. Andrews
(74) *Attorney, Agent, or Firm* — Benjamin Ford; C. Tumey Law Group PLLC

(57) ABSTRACT

A rotary steerable tool for steering a drill string may include a tool collar extending along a longitudinal axis of the tool, a pad pusher, a pad retention housing, and a piston liner. The pad pusher may be rotatable about a pivot axis thereof between retracted and extended positions relative to the tool collar, for steering the drill string. The piston liner may be coupled to the pad retention housing and have a piston channel that defines a curved profile. The piston liner may provide sealing contact against a perimeter of the piston upon pivoting of the pad pusher through the piston channel along the curved profile, relative to the piston liner.

20 Claims, 6 Drawing Sheets

(56) References Cited

U.S. PATENT DOCUMENTS

| | | | | |
|---|---|---|---|---|
| 5,971,085 | A * | 10/1999 | Colebrook | E21B 7/06 175/266 |
| 2009/0277689 | A1* | 11/2009 | Lee | E21B 10/322 175/57 |
| 2016/0222734 | A1 | 8/2016 | Winslow et al. | |
| 2018/0252088 | A1 | 9/2018 | Tilley et al. | |
| 2019/0352558 | A1 | 11/2019 | Tilley et al. | |
| 2020/0011135 | A1 | 1/2020 | Deolalikar et al. | |

FOREIGN PATENT DOCUMENTS

| | | | | |
|---|---|---|---|---|
| WO | 2016130865 | | 8/2016 | |
| WO | WO-2017065724 | A1 * | 4/2017 | E21B 7/06 |

* cited by examiner

CURVED PISTON LINER AND INTEGRAL PAD ASSEMBLY

CROSS-REFERENCE TO RELATED APPLICATIONS

This application claims priority under 35 U.S.C. § 119 to Provisional Application No. 62/612,213 filed on Dec. 29, 2017, in the United States Patent and Trademark Office.

TECHNICAL FIELD

The present disclosure generally relates to oilfield equipment and, in particular, to downhole tools, drilling and related systems for steering a drill bit. More particularly still, the present disclosure relates to pad pushers traveling along a curved path.

BACKGROUND

Drilling wellbores in a subterranean formation usually requires controlling a trajectory of the drill bit as the wellbore is extended through the formation. The trajectory control can be used to steer the drill bit to drill vertical, inclined, horizontal, and lateral portions of a wellbore. In general the trajectory control can direct the drill bit into and/or through production zones to facilitate production of formation fluids, direct the drill bit to drill a portion of a wellbore that is parallel to another wellbore for treatment or production assist, direct the drill bit to intersect an existing wellbore, as well as many other wellbore configurations.

Therefore, it will be readily appreciated that improvements in the arts of providing drill string steering system components that are more durable and easier to replace, so as to prevent wear and tear and loss of parts during drilling operations, are continually needed.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
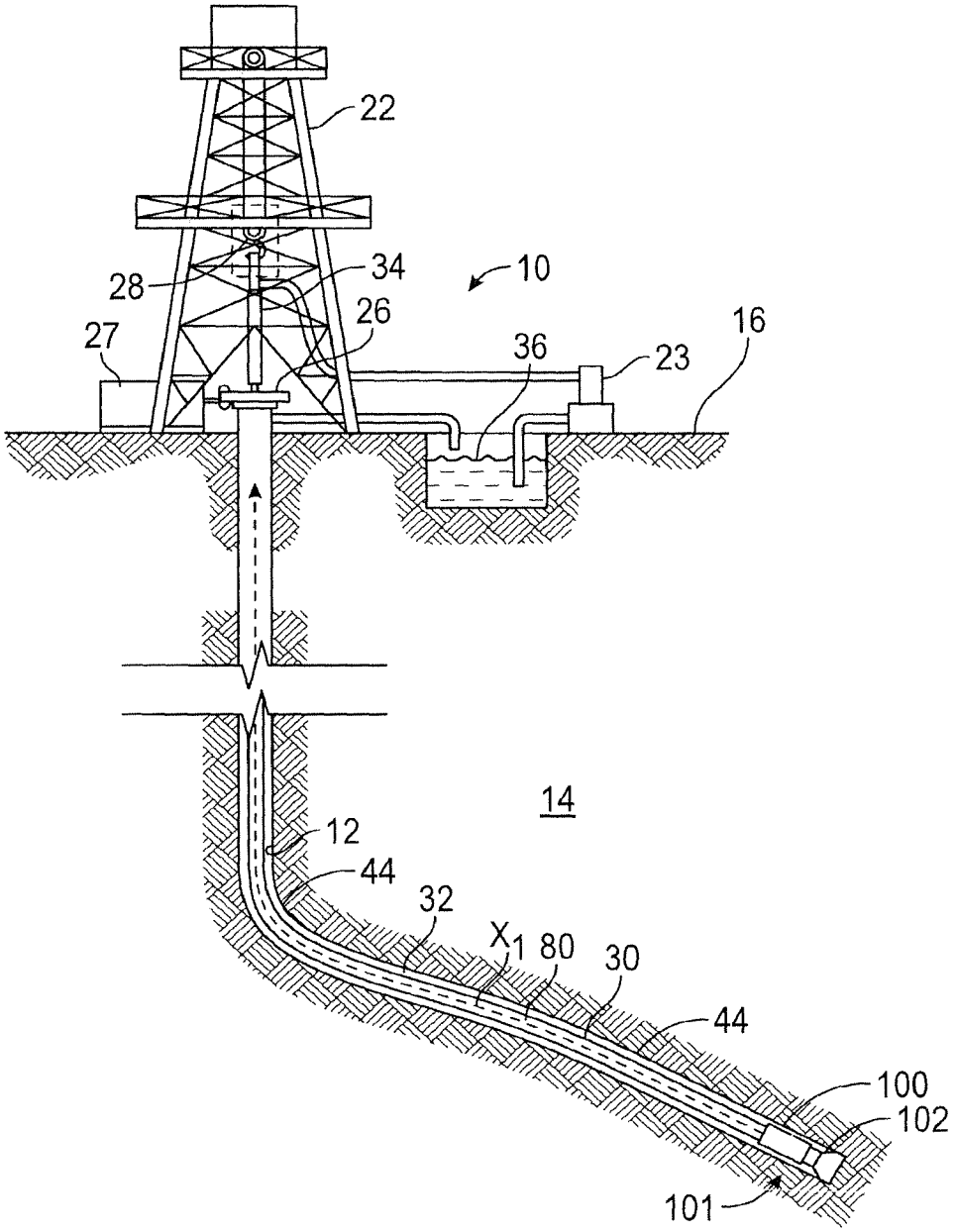
FIG. 1 illustrates a partial cross-sectional view of an onshore well system including a downhole tool illustrated as part of a tubing string, according to some embodiments of the present disclosure.

The disclosure may repeat reference numerals and/or letters in the various examples or Figures. This repetition is for the purpose of simplicity and clarity and does not in itself dictate a relationship between the various embodiments and/or configurations discussed.

The present description relates in general to downhole tools, and more particularly, for example and without limitation, to steering systems for use with a drill string and methods of use thereof.

A directional drilling technique can involve the use of a rotary steerable drilling system that controls an azimuthal direction and/or degree of deflection while the entire drill string is rotated continuously. Rotary steerable drilling systems typically involve the use of an actuation mechanism that helps the drill bit deviate from the current path using either a "point the bit" or "push the bit" mechanism. In a "point the bit" system, the actuation mechanism deflects and orients the drill bit to a desired position by bending the drill bit drive shaft within the body of the rotary steerable assembly. As a result, the drill bit tilts and deviates with respect to the wellbore axis. In a "push the bit" system, the actuation mechanism is used to instead push against the wall of the wellbore, thereby offsetting the drill bit with respect to the wellbore axis. While drilling a straight section, there are various techniques that may be employed such as the actuation mechanism remains disengaged, so that there is generally no pushing against the formation, or the actuation mechanism does not actuate in a geosynchronous manner so as to average over time an offset on the drill bit in no particular direction of significance. Optionally, the actuation mechanism remains uniformly engaged, so there is no appreciable offset of the drill bit with respect to the wellbore axis. As a result, the drill string proceeds generally concentric to the wellbore axis. Yet another directional drilling technique, generally referred to as the "push to point," encompasses a combination of the "point the bit" and "push the bit" methods. Rotary steerable systems may utilize a plurality of steering pads that can be actuated in a lateral direction to control the direction of drilling, and the steering pads may be controlled by a variety of valves and control systems.

Various embodiments of the present disclosure relate to an integrally formed steering pad and piston mounted to a tool collar through a pad retention housing, and a piston liner having a channel or bore in which the piston reciprocates. In some embodiments, described herein, the channel or bore in which the piston reciprocates may be a linear channel or bore. In yet other embodiments, the channel or bore in which the piston reciprocates may be a curved channel or bore. Generally the present disclosure describes a rotary steerable tool for steering a drill string in which the pad pushers may move together as a single integrated unit along the channel, which may either be curved or linear. Advantageously, using a piston liner with a curved channel may reduce side loading on the steering pads and may optimize the normal steering force of the steering pads against the borehole wall throughout the steering pad's range of motion. Due to positioning of a seal between the piston and the piston liner, the piston may not actually contact the curve liner. This yields the advantage of allowing the integrally formed pad pushers to move without becoming jammed. Thus, wear and tear on the piston liner may be reduced.

Incorporating the piston liner as a component separate from the pad retention housing makes it possible to use a stronger, more elastic and ductile material for the pad retention housings. This is advantageous in that the pad retention housings are generally structural members which are better served having these properties, whereas the piston liner is better served having a hard abrasion resistant material on an inner diameter thereof where the mud and the seal make contact.

The various embodiments described herein may allow for improved focus of steering forces across a specific segment of tool rotation, as well as greater reliability and ease of maintenance for the steering pad assemblies.

FIG. 1 illustrates a partial cross-sectional view of an onshore well system including a downhole tool illustrated as part of a tubing string, according to some embodiments of the present disclosure. As illustrated in FIG. 1, the onshore well system 10 can include a drilling rig (or derrick) 22 at the surface 16 used to extend a tubing string 30 into and through portions of a subterranean earthen formation 14. The tubing string 30 can carry a drill bit 102 at its end which can be rotated to drill through the formation 14. A bottom hole assembly (BHA) 101 interconnected in the tubing string 30 proximate the drill bit 102 can include components and assemblies (not expressly illustrated in FIG. 1), such as, but not limited to, logging while drilling (LWD) equipment, measure while drilling (MWD) equipment, a bent sub or housing, a mud motor, a near bit reamer, stabilizers, steering elements, and other downhole instruments. The BHA 101 can also include a downhole tool 100 that can provide steering to the drill bit 102, mud-pulse telemetry to support MWD/LWD activities, stabilizer actuation through fluid flow control, and a rotary steerable tool used for steering the wellbore 12 drilling of the drill bit 102. Steering of the drill bit 102 can be used to facilitate deviations 44 as shown in FIGS. 1 and 2, and/or steering can be used to maintain a section in a wellbore 12 without deviations, since steering control can also be needed to prevent deviations in the wellbore 12.

At the surface location 16, the drilling rig 22 can be provided to facilitate drilling the wellbore 12. The drilling rig 22 can include a turntable 26 that rotates the tubing string 30 and the drill bit 102 together about the longitudinal axis X1. The turntable 26 can be selectively driven by an engine 27, and selectively locked to prohibit rotation of the tubing string 30. A hoisting device 28 and swivel 34 can be used to manipulate the tubing string 30 into and out of the wellbore 12. To rotate the drill bit 102 with the tubing string 30, the turntable 26 can rotate the tubing string 30, and mud can be circulated downhole by mud pump 23. The mud may be a calcium chloride brine mud, for example, which can be pumped through the tubing string 30 and passed through the downhole tool 100. In some embodiments, the downhole tool 100 can include a steering head, and a rotary valve that selectively applies pressure to at least one output flow path to hydraulically actuate the steering head. Additionally, the mud can be pumped through a mud motor (not expressly illustrated in FIG. 1) in the BHA 101 to turn the drill bit 102 without having to rotate the tubing string 30 via the turntable 26.

In the illustrated embodiments, the valve body 230 can be controlled to direct drilling fluid flow to selectively urge the pad pusher 223 with a desired force, timing, and/or duration, thereby steering the drill string and drill bit in the desired drilling vector 201.

Figure 2:
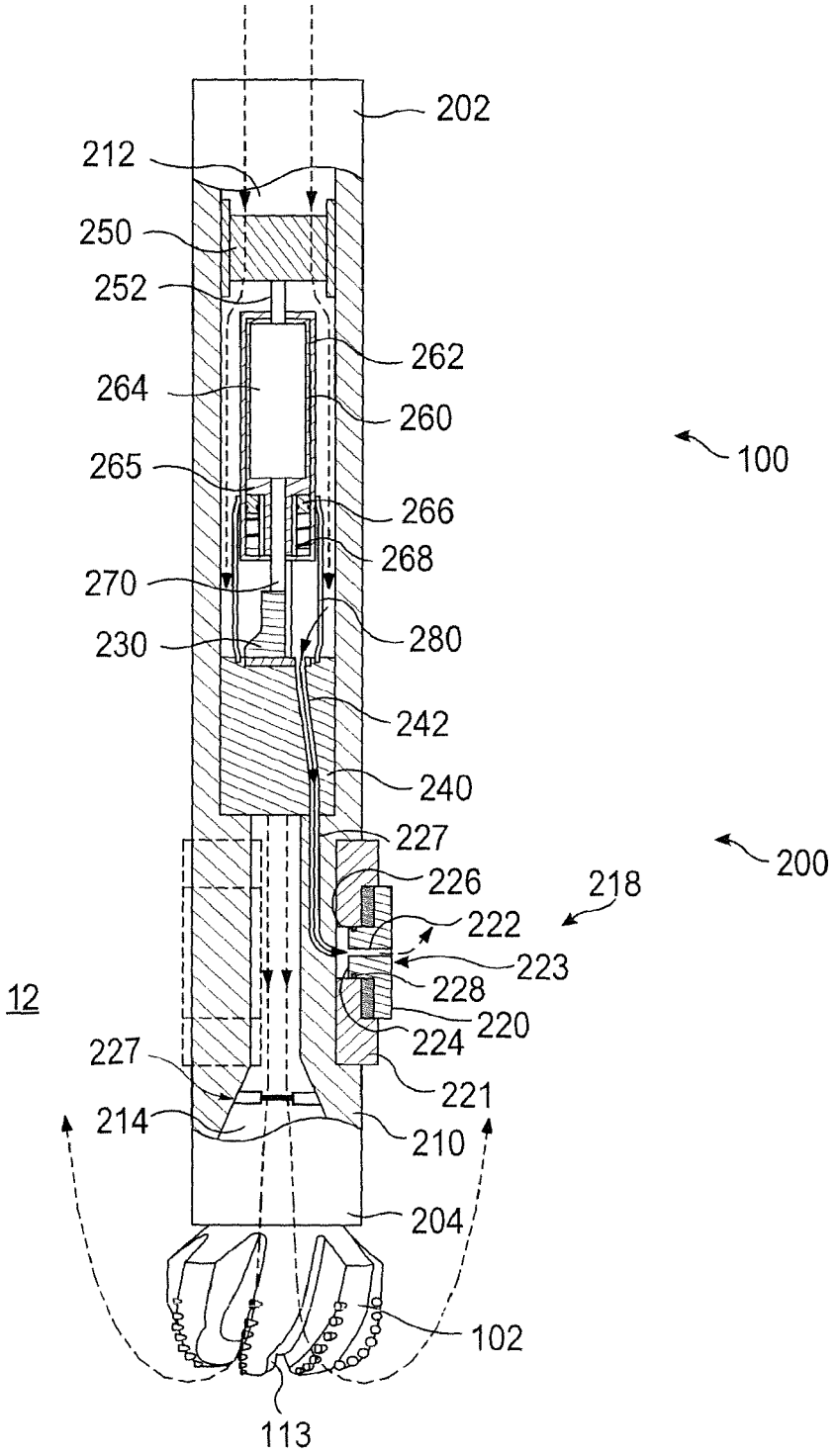
FIG. 2 illustrates a cross-sectional view of an exemplary drill string system of the downhole tool of FIG. 1, according to some embodiments of the present disclosure.

FIG. 2 illustrates a cross-sectional view of an exemplary drill string system of the downhole tool of FIG. 1, according to some embodiments of the present disclosure. According to various embodiments of the present inventions, the drill string system 200 includes a steering head 218 including one or more pad pushers 223. Although FIG. 2 depicts one pad pusher 223, the disclosed embodiments are not limited to this configuration. In some embodiments, as shall be later described, the steering head includes two or more, and more specifically, three pad pushers 223. Each of the pad pushers 223 includes a steering pad 220 and a piston 224. As depicted, the steering pad 220 and the piston 224 may be coupled to each other using any suitable coupling mechanism. In some embodiments, the steering pad 220 and the piston 224 may be integrally formed as a single continuous body or material. In yet other embodiments, however, the piston 224 and the steering pad 220 may be separate components, with the piston 224 being actuatable to contact and move the steering pad 220 to push against the earth 102 to provide the desired drilling vector.

As depicted, the steering head 218 is configured with a channel or bore 226 in which the piston 224 reciprocates upon being hydraulically or otherwise actuated. In some embodiments, the piston channel or bore 226 may be a linear channel or bore. In yet other embodiments, the piston channel or bore 226 in which the piston 224 reciprocates may be a curved channel or bore (illustrated in FIG. 6).

In the illustrated embodiments, hydraulic fluid 203, e.g. mudflow flows into the drill string steering system 200 from the uphole end 202 and passes through the central bore 212 to a rotary valve 230 and a flow manifold 240 to control mud flow to actuate the piston 224 which then operates to extend the steering pad 220.

As the mud flows through the central bore 212, the mud can flow through a turbine 250 and past an electric generator, steering controller and electric motor assembly 260 used to control the angular position of the rotary valve 230. In the illustrated embodiments, mudflow 203 can pass through a filter screen 280 prior to passing through the rotary valve 230 and the flow manifold 240. The filter screen 280 can include apertures or openings sized to allow the flow of mud while preventing debris from passing through the flow manifold 240 and to components downstream of the flow manifold 240 to prevent obstruction and damage to the downstream components. The filter screen 280 can be formed from a metallic or ceramic perforated cylinder or mesh or any other suitable filter material.

In the illustrated embodiments, the rotary valve 230 and the flow manifold 240 regulate or control the flow of the mud therethrough to control the extension of the steering pads 220. In some embodiments, the rotation of the rotary valve 230 abutted against the flow manifold 240 controls the flow of mud through the flow manifold 240. The rotary valve 230 is rotated by a motor 264 within an electric generator, steering controller and electric motor assembly 260.

In the illustrated embodiments, as mud flow is permitted by the rotary valve 230, the mud flow can continue in a piston flow channel 242 of the flow manifold 240. In some embodiments, a piston flow channel 242 can pass through the flow manifold 240 and the tool body 210 to provide mud flow to the piston channel or bore 226. As depicted in the illustrated embodiment, the tool body 210 includes one piston bore 226. However, as shall be illustrated and described in the various embodiments of the present disclosure, the tool body can include one or more piston bores 226 formed in the tool body 210. In some embodiments, the piston bores 226 are disposed within pad retention housings 221 formed within the tool body 210. In the illustrated embodiments, mud flow from the piston flow channel 242 is received by the piston bore 226 and piston seals 228 to actuate and extend the piston 224. As illustrated, the steering pad 220 is integrally formed with the piston 224. However, as previously discussed, the steering pad 220 and the piston 224 may be separately formed and otherwise coupled. As described herein, the combination of the steering pad 220 and the piston 224, whether being formed as separate parts that are coupled together, or being formed as a part of a single, continuous body, shall be referred to as a pad pusher 223. The pad pusher 223 may be actuated by the mud flow provided through the piston flow channel 242, to extend the steering pad 220 radially outwardly against the wall of the wellbore 12. The movement of each pad pusher is coordinated during drilling to control the direction the downhole tool 100 is steered. In some embodiments, each piston seal 228 may be disposed surrounding an outer peripheral surface of the piston 224. The piston seal 228 may be interposed between the outer peripheral surface of the piston 224 and an inner diameter of the piston liner 231. This configuration yields the advantage of preventing direct contact between the piston 224 and the piston liner 231, thereby reducing piston wear. Pressure against the piston 224 can be relieved by a relief flow channel 222 formed through the pad pusher 223. Mud flow can pass through the relief channel 222 to allow for maintaining or reducing pressure upon the piston 224 to facilitate the retraction of the piston 224 when the rotary valve 230 is has closed mud flow to that piston.

In some embodiments, the mud flow can bypass the filter screen 280 and the flow past the manifold 240 to continue through the central bore 212 as a bypass flow 214. The bypass flow 214 can continue through the downhole end 204 of the drill string steering system 200 and can be directed to the bit nozzles 113 of the drill bit 102 to be circulated into an annulus of the wellbore 12.

In the illustrated embodiments, the motor 264 is an electrical motor that can be controlled to rotate the rotary valve 230 as desired to provide a desired drilling vector. In the illustrated embodiments, the motor 264 is contained within a motor housing 262 and rotates the rotary valve 230 via a motor shaft 270. In some embodiments, the motor 264 maintains the rotary valve 230 in a geostationary position as needed.

In the illustrated embodiments, components of the electric generator, steering controller and electric motor assembly 260 can be disposed, surrounded, bathed, lubricated, or otherwise exposed to a lubricant 265 within the motor housing 262 while many of the controller electronic components are protected in a protective pressure barrier cavity (not shown). In some embodiments the lubricant 265 is oil that is isolated from the mud within the wellbore. In the illustrated embodiments, the pressure of the lubricant 265 can be balanced with the downhole pressure of the mud. In some embodiments, a compensation piston 266 can pressurize the lubricant 265 to the same pressure as the surround mud without allowing fluid communication or mixing of the mud and the lubricant 265. In some embodiments, a biasing spring 268 can act upon the compensation piston 266 to further provide additional pressure to the lubricant 265 within the motor housing 262 relative to the pressure of the mud. The biasing spring 268 can impart around 25 psi of additional pressure, over the mud pressure, to the lubricant 265 within the motor housing 262. In some embodiments, electrical energy for the motor 264 is generated by mud flow passing through the turbine 250. In some embodiments, the turbine 250 can rotate about a turbine shaft 252 and power an electric generator.

In the example illustrated in FIG. 2, the pad pusher 223 is actuated by receiving mudflow 203 in the piston bore 226 from the piston flow channel 242. A piston seal 228 prevents the migration of fluid out of the piston bore 226. As the pad pusher 223 extends, the steering pad 220 can pivot relative to the tool collar 211.

Figure 3:
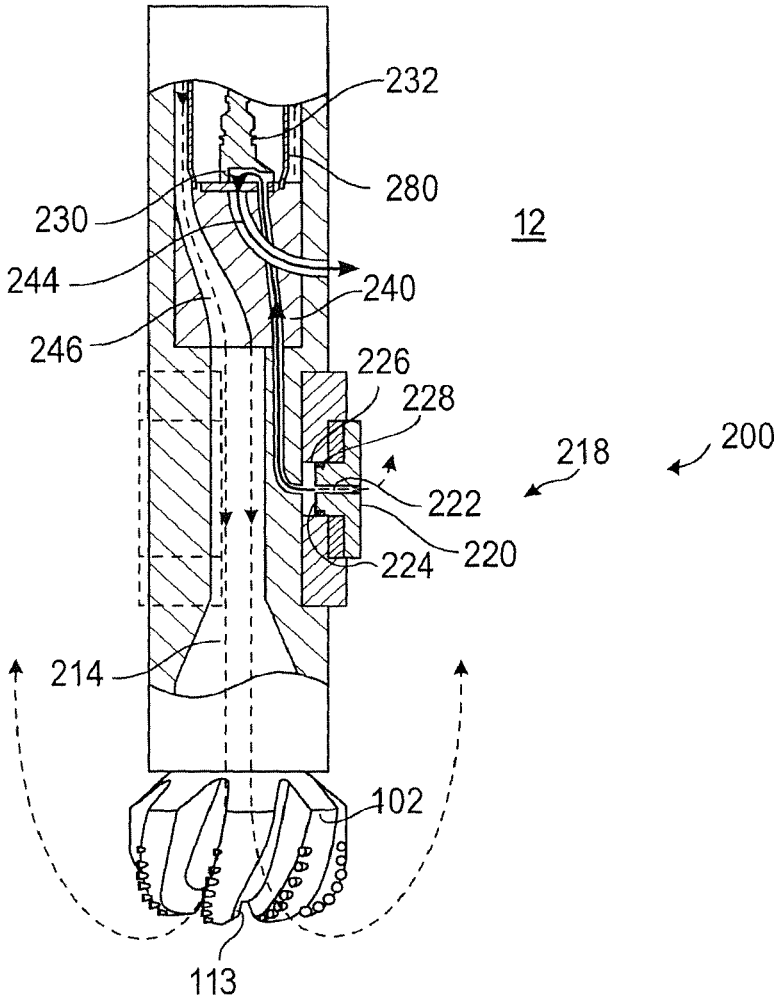
FIG. 3 is a sectional view of the drill string steering system of FIG. 2, according to some embodiments of the present disclosure.

FIG. 3 is a cross-sectional view of the drill string steering system of FIG. 2, according to some embodiments of the present disclosure. In the illustrated embodiments, the drill string steering system 200 can facilitate and control the retraction of the pad pushers 223 as the pad pushers 223 are subject to pressure and forces from the wellbore environment. Advantageously, by facilitating the retraction of the pad pushers 223, the steering response of the drill string steering system 200 can be improved, while minimizing the amount of actuation force needed to be applied to actuate pad pushers 223.

In the illustrated embodiments, the valve body 230 can be controlled to facilitate steering pad 220 retraction by directing drilling fluid from the piston bore 226 to the annulus of the wellbore 12 via an exhaust channel 244 of the flow manifold 240. In the illustrated embodiments, the valve body 230 has sealed off mud flow to the piston 224. As the pad pusher 223 receives pressure from the wellbore environment, the piston 224 of the pad pusher 223 can retract within the piston bore 226. In the illustrated embodiments, mud from the piston bore 226 can backflow through the piston flow channel 242 to the valve body 230. The valve body 230 can direct the backflow to the exhaust channel 244 of the flow manifold 240 as the pad 220 is retracted. The backflow from the piston bore 226 can be directed to the annulus of the wellbore 12 via the exhaust channel 244.

In the illustrated embodiments, a relief flow channel 222 formed in the pad pusher 223 can further facilitate steering pad 220 retraction by directing drilling fluid through the pad pusher 223 to the annulus of the wellbore 12. Similarly, as the pad pusher 223 receives pressure from the wellbore environment, mud from within the piston bore 226 can flow through the relief flow channel 222 to facilitate retraction of the pad pusher 223.

Figure 4:
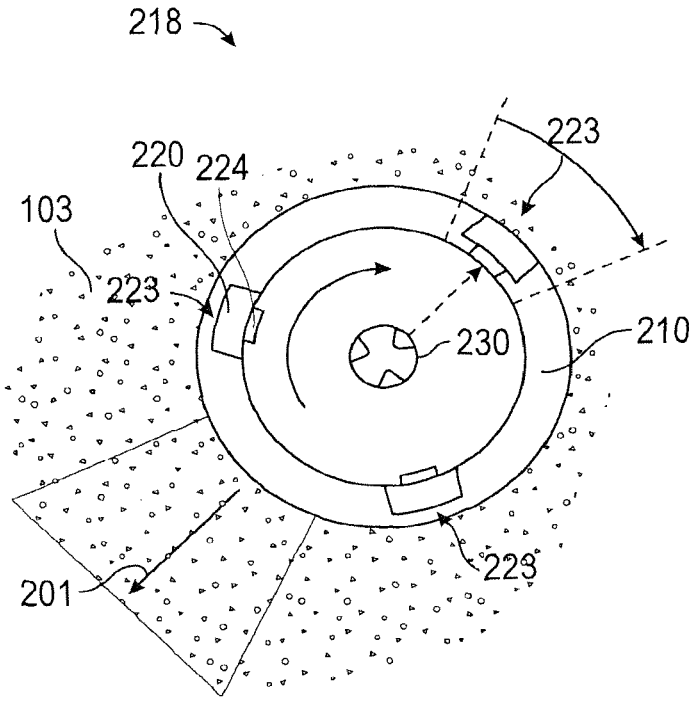
FIG. 4 is a schematic view of a steering head of the drill string steering system of FIG. 2, according to some embodiments of the present disclosure.

FIG. 4 is a schematic view of a steering head 218 of the drill string steering system 200 of FIG. 2, according to some embodiments of the present disclosure. In the illustrated embodiments, the steering head 218 utilizes one or more pad pushers 223 extending from the tool body 210 to push against the earth 102 to provide the desired drilling vector 201. In the illustrated embodiments, the force of each pad pusher 223 of the drill string steering system 200 can be combined to provide the desired drilling vector 201. Further, in some embodiments, the timing and the duration of force of each pad pusher 223 can be controlled to control the desired drilling vector 201. As illustrated, the drill string steering system 200 includes three pad pushers 223.

Figure 5:
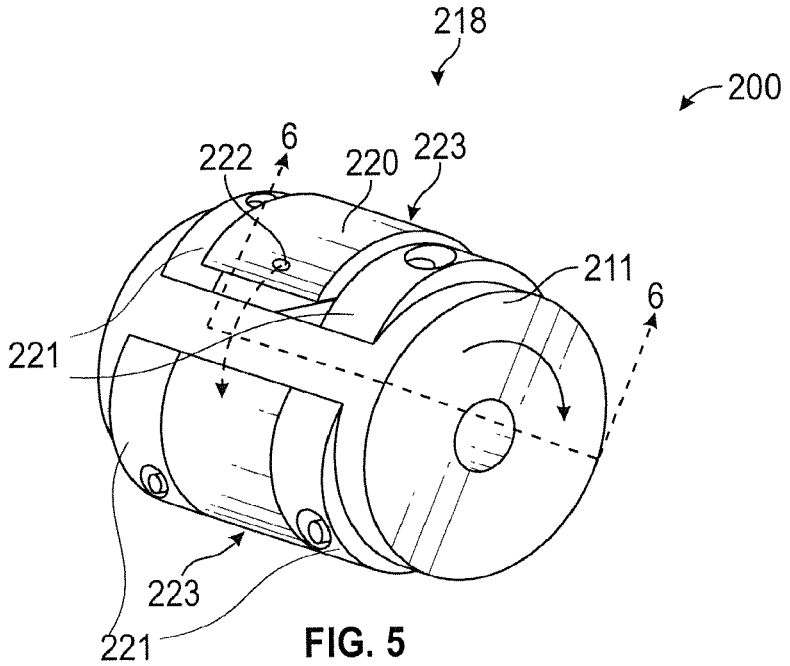
FIG. 5 is a perspective sectional view of an exemplary embodiment of a steering head of the drill string steering system of FIG. 2, according to some embodiments of the present disclosure.

FIG. 5 is a perspective sectional view of an exemplary embodiment of a steering head 218 of the drill string steering system of FIG. 2, according to some embodiments of the present disclosure. In the depicted embodiments, the steering head 218 includes a plurality of pad pushers 223 mounted onto or about the collar 211. Although two pad pushers are depicted in FIG. 5, the steering head 218 is not limited to this configuration and may include only one pad pusher 223, or more than two pad pushers 223 (as illustrated in FIG. 4). In some embodiments, the steering head 218 includes one or more pad retention housings 221. Although two pad retention housings 221 are depicted in FIG. 5, the steering head 218 is not limited to this configuration and may include only one pad retention housing 221 or more than two pad retention housings 221. As illustrated in FIG. 5, each of the pad retention housings 221 may be mounted onto the collar 211 using fasteners 318. The fasteners 318 are positioned through each of the pad retention housings 221 to couple the pad retention housings 221 to each other around and/or through the collar 211.

As further illustrated in FIG. 5, each of the pad pushers 223 can be mounted to the collar 211 via a respective pad retention housing 221. That is, since each of the pad pushers 223 are directly, pivotally coupled to a respective housing 221, the pads pushers 223 are thus indirectly coupled to the collar 211 through the pad retention housings 221. Each pad pusher 223, can be movable between a retracted position and an extended position relative to the tool collar 211. For example, FIG. 5 illustrates two pad pushers 223 each having steering pads 220, the upper steering pad 220 being in an extended position, and the lower steering pad 220 being in the retracted position. In the extended position, the steering pad 220 of each pusher pad 223 pivots radially outward with respect to the tool collar 211 to contact the formation so as to direct a steering direction of the downhole tool 100.

Figure 6:
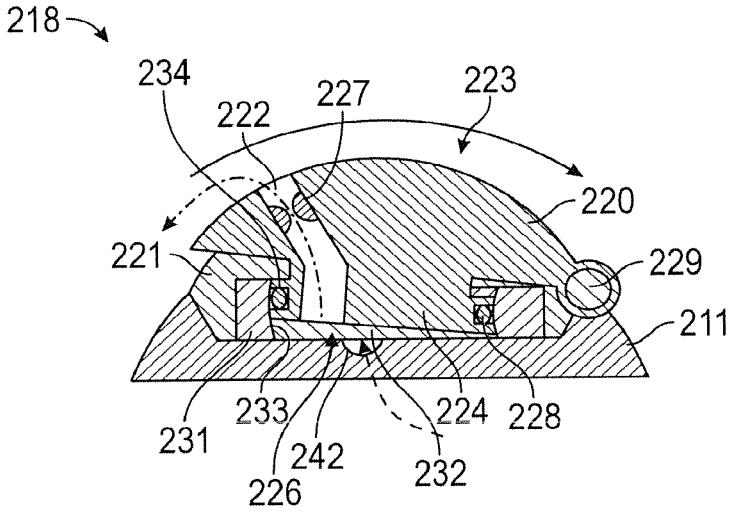
FIG. 6 is a cross-sectional view of an exemplary pad pusher of the steering head of the drill string steering system of FIG. 5, according to some embodiments of the present disclosure.

FIG. 6 is a cross-sectional view of an exemplary pad pusher 223 of the steering head 218 of the drill string steering system 200 of FIG. 5, according to some embodiments of the present disclosure. As illustrated in FIG. 6, the steering head includes a curved piston bore 226 within which the piston 224 reciprocates in order to produce a corresponding motion of the steering pad 220. As depicted, the pad pusher 223 is an integrally formed steering pad 220 and piston 224. The term "integrally formed" can refer to a configuration in which the steering pad 220 and the piston 224 are formed as a single, continuous body or material. Thus, the steering pad 220 and the piston 224 move together along the same curved path. Advantageously, integrating the steering pad 220 and the actuating piston 224 into a single continuous body may reduce the number of distinct moving parts in the assembly and the exposure to washing between separate parts. This has the effect of making the steering pads/pistons more durable and easier to replace. Additionally, since the steering pad 220 and the piston 224 move as a unit, this has the advantage in that the piston 224 may not cause any wear on a piston liner 231 which defines the piston bore 226.

In some embodiments, the steering pad 220 can have a semi-circular cross-sectional profile. Thus, the piston 224 may be maintained at a constant radial arm relative to the steering pad 220.

In the illustrated embodiment of FIG. 6, the pad pusher 223 can be actuated by receiving mudflow in the piston bore 226 from the piston flow channel 242. A piston seal 228 prevents the migration of fluid out of the piston bore 226. During actuation, the relief flow channel 222 can control the actuation force of the pad pusher 223. The pad pusher 223 can be attached to the tool collar 211 via a pivot coupling 229. As the pad pusher 223 extends, the steering pad 220 can pivot about the pivot coupling 229 relative to the tool collar 211. Since the steering pad 220 and the piston 224 are integrally formed, the steering pad 220 and the piston 224 can move together along the same curved path. In some embodiments the curved path is defined by the curved piston liner 231 defining the piston bore 226. That is, the piston liner 231 may have a piston channel (piston bore 226) that defines a curved profile. The piston liner 231 is coupled to the pad retention housings 221. That is, in some embodiments, the piston liner 231 may be threadedly coupled to the pad retention housings 221. However, in some embodiments, the piston liner is not limited to the aforementioned configuration. Instead, each piston liner 231 may be interposed or geometrically constrained between two sections or end portions of the pad retention housings 221. The piston liner 231 may be configured to provide sealing contact against a perimeter of the piston 224 upon pivoting of the pad pusher 223, through the piston channel (bore) 226 along the curved profile, relative to the piston liner. Thus, the piston 224 may be actuated by the hydraulic fluid 203, e.g., pressurized mud flow, thereby causing the piston 224 and the steering pad 220 which move as an integral part, to move along the curved path defined by the piston liner 231 along a radius determined by the distance to the center of the pivot coupling 229.

For example, the curved piston liner 231 can comprise a piston channel 232 having an arcuate side cross-sectional profile. As illustrated in FIG. 6, the piston channel 232 of the piston liner 231, when seen in side cross-sectional view, has sidewalls 233 that are arranged as substantially parallel curves. As discussed herein, the piston liner 231 is configured to provide sealing contact against a perimeter 234 of the piston 224 (e.g., against the seal 228) as the piston 224 pivots through the piston channel 232 along the curved profile relative to the piston liner 231.

The piston channel 232 of the piston liner 231 can have one of a variety of opening shapes (e.g., the shape of the opening when seen in top or plan view, which is orthogonal to the view of FIG. 6). For example, the shape of the piston channel 232 can be generally circular or polygonal, such as square or rectangular. The shape of the piston channel 232 can permit the piston 224 to travel through the piston channel 232 and facilitate maintenance of a seal between the piston 224 and the piston liner 231.

Additionally, in some embodiments, the piston channel 232 can be formed as a three-dimensional solid of revolution, which can be created by rotating the opening shape of the piston channel 232 about the pivot axis of the steering pad 220 or pivot coupling 229 between top and bottom surfaces of the piston liner 231. As such, the resultant three-dimensional shape will provide a channel having a cross-sectional shape as illustrated in FIG. 6. However, other characterizations or methods for determining the shape or geometry of the piston channel 232 can be used.

Advantageously, the curved piston liner 231 can allow the pad pusher 223 to travel along a track that reduces side loading on the steering pad 220. Further, the curved piston liner 231 optimizes the normal steering force of the steering pad 220 against the wall of the wellbore 12 throughout the steering pad's entire range of extension. In some embodiments, the curved piston liner is formed from of a material having a hardness of at least 1000 Vickers.

As a further advantage, incorporating the curved piston liner 231 into the steering head 218 as a component separate from the pad retention housings 221 also makes it possible to use a stronger, more elastic and ductile material for the pad retention housings 221. This can advantageously enable the pad retention housings 221 to function as structural members that benefit from such properties. Further, the piston liner 231 can advantageously have a hard, abrasion-resistant material on an inner diameter thereof where the mud and the seal 228 make contact. Thus, the stronger, more elastic and ductile material can be used for the pad retention housings 221 while giving the freedom to optimize the liner material for surface smoothness. This can tend to reduce friction between the curved piston liner 231 the piston 224. Thus, in some embodiments, the described configuration can allow the piston liner material to be optimized for surface smoothness while still allowing for a strong, elastic, and ductile material to be used for the structural housing that connects the pad pusher to the collar. In some embodiments, the piston liner may include an abrasion resistant material to better withstand any potential adverse effects observed due to the piston reciprocating with respect to the piston liner. For example, in some embodiments, the piston liner may be formed of a tungsten carbide material or a cobalt chromium alloy such as Stellite, or any other suitable hard abrasion resistant materials. Advantageously, these features allow for improved focus of steering forces across a specific segment of tool rotation. Furthermore, greater reliability and ease of maintenance for the steering head 218 is achieved.

In the illustrated embodiments, the relief flow channel 222 formed in the pad pusher 223 can control the rate of retraction of the pad pusher 223. In some embodiments, the rate of retraction of the pad pusher 223 can be modified by adjusting the size of the relief flow channel 222. In some embodiments, the orientation of the outlet of the relief flow channel 222 can be configured to be exhausted behind the steering pad 220 with respect to the direction of rotation of the tool body 210. Advantageously, the relief flow channel 222 can be utilized to tailor the amount of force exerted on the pad pusher 223. Further, the relief flow channel 222 can remove debris or otherwise clean out the area surrounding the pad pusher 223.

In some embodiments, the rate of retraction of the pad pusher 223 can be modified by the addition of a choke valve 227 (illustrated in FIG. 2) in the flow path of the relief flow channel 222. In some embodiments, characteristics of the choke valve 227 can be selected to provide a desired steering pad 220 response. For example, a wider choke valve 227 can provide less steering pad 220 force during actuation. Further, a smaller choke valve 227 can provide an increased retraction time for the steering pad 220. The steering pad 220 response can be selected based on an intended formation as well as an intended rotational speed. Selection of the choke size can be dependent upon various other hydraulic parameters the steering tool will be operating in such as anticipated ranges of drilling mud viscosity, drilling mud density, drilling mud flow rate and desired pressure difference needed in the piston chamber verses the wellbore when the steering pad needs to push against the wellbore.

Figure 7A:
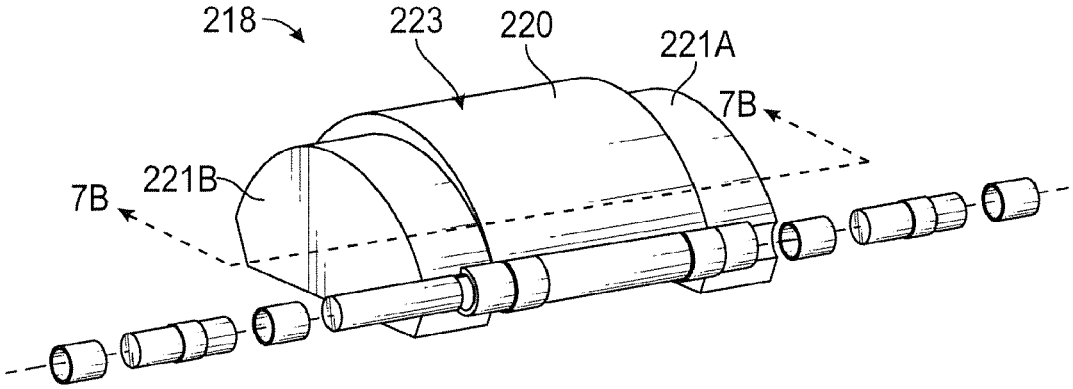
FIG. 7A is an exploded view illustrating a coupling mechanism of a pad pusher and a pad retention housing of the steering head of FIG. 5.
Figure 7B:
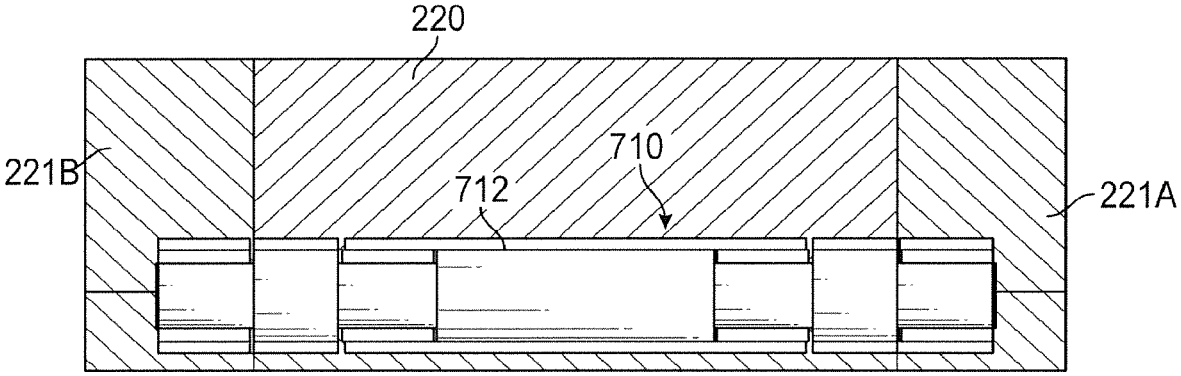
FIG. 7B is a side cross-sectional view of FIG. 7A, according to some embodiments of the present disclosure.

FIG. 7A is an exploded view illustrating a coupling mechanism of a pad pusher 223 and a pad retention housing 221 of the steering head of FIG. 5, and FIG. 7B is a side cross-sectional view of FIG. 7A, according to some embodiments of the present disclosure. As illustrated in FIGS. 7A and 7B, the pad pusher 223 and the pad retention housing 221 are pivotally coupled through a hinge 710. The pad pusher 223 may be pivotally coupled about an axis parallel to a central axis of the collar 211. The extension and retraction of the pad pusher 223 is articulated around the hinge 710. As illustrated in FIGS. 7A and 7B, the hinge 710 is a dowel and bushing hinge. To this effect, the hinge 710 may be designed using bushings and dowel pins. Thus, the motion of the pad pusher 223 is not determined by the piston bore 226, but instead is articulated around the hinge. The fact that movement is articulated along the hinge 710, and the piston does not actually contact the curved liner provides the advantage of allowing the pad/piston to move without jamming, and reduces wear on the piston and liner. Although the pad pusher 223 and the pad retention housing are illustrated as being coupled to each other through a dowel and bushing hinge, the steering head of the various embodiments described herein is not limited to this configuration. In other embodiments, the pad pusher 223 and the pad retention housing 221 may be pivotally or otherwise coupled to each other using any appropriate coupling mechanism.

In accordance with some embodiments, as illustrated in FIGS. 7A and 7B, the pad retention housing 221 that secures the pad pusher 223 to the tool collar may be a two-part retention housing. Thus, a first housing 221A of the two part housing may be positioned at the downhole side of the pad pusher. Accordingly, a second housing 221B of the two part housing may be positioned at the uphole side of the pad pusher. Advantageously, this configuration allows easy assembly and sturdy connection of the pad pusher 223 to the rotary steerable tool collar 211.

The aforementioned configurations of pad pushers and pad retention housings, taken individually or combined as steering heads, can each provide the advantage of decreasing the negative effects that downhole vibrations will have on the reliability of the steering pads 220 downhole. The robust design of the steering heads described herein improves downhole reliability, resulting in fewer drilling hours lost for tool repairs and reduced replacement and maintenance costs.

Various examples of aspects of the disclosure are described as numbered clauses (1, 2, 3, etc.) for convenience. These are provided as examples and do not limit the subject technology. Identification of the figures and reference numbers are provided below merely as examples for illustrative purposes, and the clauses are not limited by those identifications.

Clause 1: A rotary steerable tool for steering a drill string, the tool comprising: a tool collar extending along a longitudinal axis of the tool; a pad pusher including a steering pad and a piston integrally formed as a single body, the pad pusher being rotatable about a pivot axis thereof between retracted and extended positions relative to the tool collar for steering the drill string; a pad retention housing mounting the pad pusher to the tool collar; and a piston liner coupled to the pad retention housing, and having piston channel that defines a curved profile, wherein the piston liner is sealingly contacts a perimeter of the piston upon pivoting of the pad pusher through the piston channel along the curved profile relative to the piston liner.

Clause 2: The tool of Clause 1, further comprising a seal disposed surrounding an outer peripheral surface of the piston.

Clause 3: The tool of Clause 2, wherein the seal is interposed between the outer peripheral surface of the piston and an inner diameter of the piston liner for preventing direct contact between the piston and the piston liner.

Clause 4: The tool of Clause 1, wherein the curved profile, when seen is side cross-sectional view, comprises substantially parallel curves.

Clause 5: The tool of Clause 1, wherein the pad pusher is pivotally coupled to the pad retention housing about an axis parallel to a central axis of the collar extending along a length thereof.

Clause 6: The tool of Clause 1, wherein the pad pusher is pivotally coupled to the housing through a hinge.

Clause 7: The tool of Clause 6, wherein extension and retraction of the pad pusher is rotationally articulated about a hinge pin of the hinge.

Clause 8: The tool of Clause 6, wherein the hinge comprises a dowel pin and bushing hinge.

Clause 9: The tool of Clause 1, wherein the piston liner comprises a liner material separate from the housing.

Clause 10: The tool of Clause 9, wherein the piston liner is disposed in a bore defined by the pad retention housing.

Clause 11: The tool of Clause 9, wherein the pad retention housing comprises a material having greater strength than the piston liner.

Clause 12: The tool of Clause 11, wherein the pad retention housing comprises a material having at least one of (1) greater elasticity, or (2) greater ductility, than the piston liner.

Clause 13: The tool of Clause 1, wherein the pad retention housing comprises at least one of a strong, elastic, or ductile material.

Clause 14: The tool of Clause 1, wherein the piston liner comprises an abrasion resistant material.

Clause 15: The tool of Clause 1, wherein the piston liner comprises a material having a hardness of at least 1000 Vickers.

Clause 16: The tool of Clause 1, wherein the piston is maintained at a constant radial arm relative to the steering pad.

Clause 17: The tool of Clause 1, further comprising a rotary valve actuatable to selectively permit passage of hydraulic fluid to the pad pusher for pivoting the steering pad between the retracted and extended positions.

Clause 18: The tool of Clause 17, further comprising a motor operatively coupled to the valve to selectively open and close the valve thereby controlling flow of the hydraulic fluid through the valve.

Clause 19: The tool of Clause 18, further comprising a generator to convert mechanical power generated by the hydraulic fluid to electric power to power the motor.

Clause 20: The tool of Clause 19, further comprising a turbine disposed on an upper portion of the tool to generate mechanical power from the mudflow to turn the generator which powers the motor.

Clause 21: The tool of Clause 17, wherein the hydraulic fluid comprises pressurized mud.

Clause 22: A method of assembling a rotary steerable tool for steering a drill string, wherein the steerable tool includes a steering pad and a piston integrally as a pad pusher, a pad retention housing, and a piston liner, the method comprising: coupling the piston liner to the pad retention housing to form a curved piston channel therethrough; mounting the pad pusher to the pad retention housing with the piston disposed in the curved piston channel; and coupling the pad retention housing to a collar of the tool, wherein the pad pusher is movable between retracted and extended positions relative to the tool collar for steering the drill string.

Clause 23: The method of Clause 22, further comprising disposing a seal around an outer peripheral surface of the piston for preventing direct contact between the piston and the piston liner, wherein the seal is interposed between the outer peripheral surface of the piston and an inner diameter of the piston liner.

Clause 24: The method of Clause 22, wherein the pad pusher is pivotally coupled to the housing about an axis parallel to a central axis of the collar extending along a length thereof.

Clause 25: The method of Clause 22, wherein the piston liner is threadedly coupled to the pad retention housing.

Clause 26: A steering head for steering a drill string, the steering head comprising: a pad retention housing; a piston reciprocably disposed in a curved piston liner, the curved piston liner coupled to the pad retention housing; a steering pad integrally formed with the piston to form a pad pusher, the steering pad being pivotably coupled to the pad retention housing and moveable between retracted and extended positions relative to the pad retention housing; and a tool collar, the pad retention housing mounting the pad pusher to the collar.

Clause 27: The steering head of Clause 26, further comprising a seal disposed surrounding an outer peripheral surface of the piston.

Clause 28: The steering head of Clause 27, wherein the seal is interposed between the outer peripheral surface of the piston and an inner diameter of the piston liner for preventing direct contact between the piston and the piston liner.

Clause 29: The steering head of Clause 26, wherein the piston liner comprises a liner material separate from the pad retention housing.

Clause 30: The steering head of Clause 26, wherein the piston liner is disposed in a bore defined by the pad retention housing.

Clause 31: The steering head of Clause 26, wherein the pad retention housing comprises a material having greater strength than the piston liner.

Clause 32: The steering head of Clause 31, wherein the pad retention housing comprises a material having at least one of (1) greater elasticity, or (2) greater ductility, than the piston liner.

Clause 33: The steering head of Clause 26, wherein the pad retention housing comprises at least one of a strong, elastic, or ductile material.

Clause 34: The steering head of Clause 26, wherein the piston liner comprises an abrasion resistant material.

Clause 35: The steering head of Clause 26, wherein the piston liner comprises a material having a hardness of at least 1000 Vickers.

Clause 36: The steering head of Clause 26, wherein the piston is maintained at a constant radial arm relative to the steering pad.

What is claimed is:

1. A rotary steerable tool for steering a drill string, the tool comprising:

a tool collar extending along a longitudinal axis of the tool;

a pad pusher including a steering pad and a piston integrally formed as a single body, the pad pusher being rotatable about a pivot axis thereof between retracted and extended positions relative to the tool collar for steering the drill string;

a pad retention housing mounting the pad pusher to the tool collar; and a piston liner coupled to the pad retention housing, and having a piston channel that defines a curved profile, wherein the piston liner is sealingly disposed against a perimeter of the piston having a radius matching the curved profile of the piston channel as the piston pivots through the piston channel along the curved profile relative to the piston liner.

2. The tool of claim 1, further comprising a seal disposed surrounding an outer peripheral surface of the piston.

3. The tool of claim 2, wherein the seal is interposed between the outer peripheral surface of the piston and an inner diameter of the piston liner for preventing direct contact between the piston and the piston liner.

4. The tool of claim 1, wherein the pad retention housing is a two-part retention housing comprising a first housing positioned at a downhole side of the pad pusher and a second housing positioned at an uphole side of the pad pusher, and wherein the pad pusher is pivotally coupled to the housing through a hinge that extends through the pad pusher and into the first and second housings.

5. The tool of claim 1, wherein the piston defines an inner surface flush against the housing in the retracted position.

6. The tool of claim 1, wherein the piston liner comprises a liner material separate from the housing.

7. The tool of claim 6, wherein the piston liner is disposed in a bore defined by the pad retention housing.

8. The tool of claim 6, wherein the pad retention housing comprises a material having at least one of (1) greater elasticity, or (2) greater ductility, than the piston liner.

9. The tool of claim 1, wherein the piston liner comprises a material having a hardness of at least 1000 Vickers.

10. A method of assembling a rotary steerable tool for steering a drill string, wherein the steerable tool includes a steering pad and a piston integrally formed as a pad pusher, a pad retention housing, and a piston liner, the method comprising:

coupling the piston liner to the pad retention housing to form a curved piston channel there through;

mounting the pad pusher to the pad retention housing with the piston disposed in the curved piston channel; and coupling the pad retention housing to a collar of the tool, wherein the pad pusher is movable between retracted and extended positions relative to the tool collar for steering the drill string with the piston liner sealingly disposed against a perimeter of the piston having a radius matching the curved profile of the piston channel as the piston pivots through the piston channel.

11. The method of claim 10, further comprising disposing a seal around an outer peripheral surface of the piston for preventing direct contact between the piston and the piston liner, wherein the seal is interposed between the outer peripheral surface of the piston and an inner diameter of the piston liner.

12. The method of claim 10, wherein the pad pusher is pivotally coupled to the housing about an axis parallel to a central axis of the collar extending along a length thereof.

13. The method of claim 10, wherein the piston liner is threadedly coupled to the pad retention housing.

14. A steering head for steering a drill string, the steering head comprising:

a pad retention housing;

a piston reciprocably disposed in a curved piston liner, the curved piston liner coupled to the pad retention housing with the piston liner sealingly disposed against a perimeter of the piston having a radius matching a curved profile of the piston liner;

a steering pad integrally formed with the piston to form a pad pusher, the steering pad being pivotably coupled to the pad retention housing and moveable between retracted and extended positions relative to the pad retention housing; and a tool collar, the pad retention housing mounting the pad pusher to the collar.

15. The steering head of claim 14, further comprising a seal disposed surrounding an outer peripheral surface of the piston.

16. The steering head of claim 15, wherein the seal is interposed between the outer peripheral surface of the piston and an inner diameter of the piston liner for preventing direct contact between the piston and the piston liner.

17. The steering head of claim 14, wherein the piston liner comprises a liner material separate from the pad retention housing.

18. The steering head of claim 14, wherein the pad retention housing comprises a material having greater strength than the piston liner.

19. The steering head of claim 18, wherein the pad retention housing comprises a material having at least one of (1) greater elasticity, or (2) greater ductility, than the piston liner.

20. The steering head of claim 14, wherein the piston liner comprises a material having a hardness of at least 1000 Vickers.

* * * * *